US006059467A

United States Patent [19]

Earle

[11] Patent Number: 6,059,467

[45] Date of Patent: May 9, 2000

[54] PROCESSING PHOTOGRAPHIC MATERIAL

[75] Inventor: Anthony Earle, Harrow Weald, United Kingdom

[73] Assignee: Eastman Kodak Company, Rochester, N.Y.

[21] Appl. No.: 09/167,708

[22] Filed: Oct. 6, 1998

[30] Foreign Application Priority Data

Oct. 9, 1997 [GB] United Kingdom ..... 9721472

[51] Int. Cl.[7] ..... G03D 3/02; G03D 3/08

[52] U.S. Cl. ..... 396/617; 396/630; 396/636

[58] Field of Search ..... 396/617, 622, 396/626, 630, 636

[56] References Cited

U.S. PATENT DOCUMENTS 5,541,700 7/1996 Earle et al. ..... 396/630

OTHER PUBLICATIONS

Patent Abstracts of Japan, vol. 16, No. 12, (P–1297), Jan. 13, 1992 and JP 03 231244A (Konica Corp.), Oct. 15, 1991.

Patent Abstracts of Japan, vol. 11, No. 178, (P–584), Jun. 9, 1987 and JP 62 009530A (Fuji Photo Film Co. Ltd.), Jan. 17, 1987.

*Primary Examiner*—D. Rutledge
*Attorney, Agent, or Firm*—Frank Pincelli

[57] ABSTRACT

Exposed photographic film is washed in a multi-stage arrangement in which the film is guided through a container of solution and transferred from one stage to the next via air bubbles. The surface of solution that is exposed to the ambient atmosphere is minimized so that oxidation of the solution and the quantity needed is minimized.

14 Claims, 1 Drawing Sheet

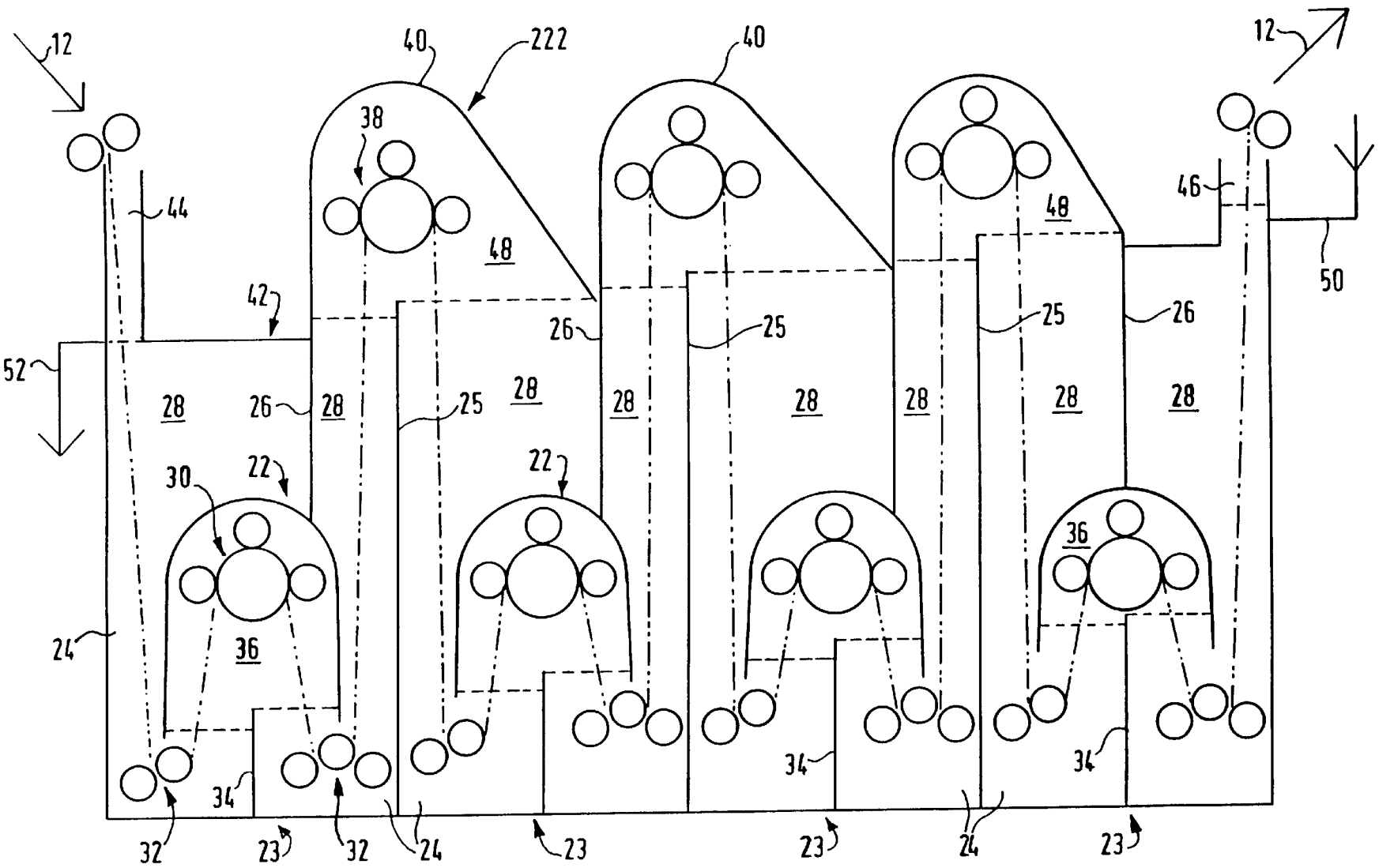
12
50
46
26
28
48
25
36
34
23
24
40
222
22
38
32
42
30
44
52

PROCESSING PHOTOGRAPHIC MATERIAL

FIELD OF THE INVENTION

This invention relates to the processing, and particularly but not exclusively the washing or stabilizing, of photographic material, usually already exposed, in which the material passes through a plurality of stages.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing." Such stages remove residual chemicals and may also include conversion reactions between stabilizer solution components and materials within the coated layers. These stages are required to provide the required degree of permanence to the final image.

In many cases, particularly in small-scale "minilab" or "microlab" equipment, the wash stage is performed in a multi-tank arrangement. Usually the replenishment of this stage, which keeps the concentration of substances removed from the photographic material at a constant and sufficiently low level, is carried out by adding fresh wash solution to the final tank of the sequence and arranging over-flow from the final tank to flow into the previous tank and so on, the overflow from the first tank of this stage being then discarded as effluent. This is referred to as a "counter-current" mode. This arrangement allows significantly lower amounts of solution to be used compared with one or two tanks especially when these are replenished separately.

In a modern minilab a typical wash replenishment system might use around 200 $cm^3$ of replenisher per $m^2$ of sensitized material processed in a three or four-tank counter-current arrangement. The time the processed material spends in each tank is typically 20 to 25 seconds during which time an equilibrium is established between the concentration of substances in the coated material and the seasoned (steady-state) concentrations in the wash solution. The total time for this stage typically varies from 60 to over 100 seconds.

U.S. Pat. No. 5,541,700 discloses a photographic processing apparatus in which two processing tanks are provided in a single container that is divided into two by an air bubble at a dividing wall. Different processing solutions can then be introduced into each tank and maintained separate by the bubble whilst allowing the photographic material being processed to pass from one tank to the other through the bubble over the wall. This allows the number of containers to be reduced.

PROBLEM TO BE SOLVED BY THE INVENTION

It is an object of the present invention to reduce the amount of solution required to be supplied for processing photographic material.

SUMMARY OF THE INVENTION

In accordance with one aspect of the present invention, there is provided apparatus for processing photographic material, comprising a container that has at least four successive regions for containing processing solution, wherein the regions are separated by walls each of which has guide means and a chamber associated therewith, whereby the photographic material is guided from one processing region to the next through gas, preferably air, that is trapped by the solution in the chamber.

The processing solution in each region may be effective to carry out the same processing, preferably washing, of the material. Alternatively, the processing solution in at least one region may be arranged to carry out processing of the material that is different from that carried out in at least one other region.

In accordance with another aspect of the present invention, there is provided apparatus for processing photographic material comprising a container for receiving processing solution through which the material is arranged to pass, wherein the container comprises means for guiding the material in a sinuous path such that the material reverses its vertical direction of movement (3+4n) times, where n is a positive integer, with the reversals taking place alternately in the solution and in gas, preferably air, that is trapped in chambers of the container by the solution.

Alternate chambers may be located at the top and at the bottom of the container.

The apparatus may comprise means arranged to cause the processing solution to flow therethrough in a direction counter to the direction of movement of the material.

In accordance with a further aspect of the present invention, there is provided a method of processing photographic material wherein the material is guided through at least four successive regions defining separate processing steps and containing processing solution, and wherein the material passes from each region to the next through a trapped gas bubble.

The material may move in a sinuous path alternately through processing solution and through gas. Preferably, the material moves in a generally downwards direction before passing through one bubble and generally upwards before passing through the next bubble. Thus, the vertical component of the direction of travel of the material may reverse as it passes through each bubble.

ADVANTAGEOUS EFFECT OF THE INVENTION

The provision of chambers of gas sealed from the atmosphere reduce the surface area of the processing solution that is exposed. This reduces the amount of oxidation of the solution and the amount of evaporation that takes place. Accordingly, less fresh solution needs to be supplied to the apparatus.

BRIEF DESCRIPTION OF THE DRAWINGS

Photographic processing apparatus and method, each in accordance with the present invention, will now be described, by way of example, with reference to the accompanying drawing, which is a schematic sectional elevation of one embodiment of a film processor.

DETAILED DESCRIPTION OF THE INVENTION

Referring to the drawing, a film processor comprises stages (not shown) for developing and bleach-fixing an exposed film 12. Subsequently, the film 12 passes into a wash stage 18 of the processor.

The wash stage 18 consists of a container 20 that houses four identical air bell arrangements 22 immersed in wash solution 24 towards the bottom of the container 20, and three similar air bell arrangements 222 interspersed longitudinally between the arrangements 22 but disposed above the level of the solution 24 in the container 20. The container 20 is divided into four sections 23 by three upstanding major walls 25 between the air bell arrangements 22. Reference will be made in detail only to one of the arrangements 22 and one of the arrangements 222. The lower air bell arrangement 22 has a wall 26 that divides the section 23 into two equi-sized tanks 28. The wall 26 is bifurcated at its lower end and contains a roller/guide assembly 30 between its forks and roller/guide assemblies 32 beyond the ends thereof. A further minor dividing wall 34 extends upwardly from the bottom of the container 20 into the region between the forks of the wall 26.

The upper air bell arrangements 222 comprise a roller/guide assembly 38 located within the ribs 40 of a wash stage cover 42 that seals on to the upper ends of the walls 26 of the lower air bell arrangements 22. The cover 42 has an inlet 44 to allow the film 12 to enter the first wash tank 28, and an outlet 46 to allow its exit from the final tank 28 of the container 20. The assemblies 39 are disposed above respective ones of the major container dividing walls 25.

The wash solution 24 is poured into the tanks 28 so as substantially to fill the container 20 around the air bell arrangements 22 and to trap a bubble of air 36 around each of the roller assemblies 30 in the bifurcated region of the walls 26 and above the minor dividing walls 34. The level of the solution 24 approaches the underside of the cover 42, but remains below the tops of the major dividing walls 25 and traps a bubble of air 48 around each upper roller/guide assembly 38.

In operation, the film 12 is guided through the processor, along a path shown by a chain-dotted line, from the inlet 44 down into the solution 24 in the first tank 28 of the wash container 20 around the outside of the air bell arrangement 22, through the first roller assembly 32, up into the air bubble 36, and around the roller assembly 30. From there, the film 12 travels into the adjacent second tank 28 down around the second roller assembly 32 and up out of the solution 24 into the air bubble 48 around the upper roller/guide assembly 38. From there the film 12 is transferred into the next dual wash tank 28 in the adjacent section 23. This process is repeated as the film is transported through the further tanks 28 of the last wash sections 23 until the film 12 finally leaves the washing stage 18 through the outlet 46 for transfer to a drying section (not shown).

It will be appreciated that the container 20 will have guide plates fitted where appropriate to ensure that the film 12 follows the correct path to and around the roller/guide assemblies; for clarity, these have not been shown in the drawing.

After the initial filling of the container 20, replenishment of the wash solution 24 during operation of the processor is carried out by supplying fresh solution through an inlet pipe 50 to the final tank 28. This changes the liquid level in the air bell 36 of the final section 23, setting up a countercurrent flow of the wash solution 24 from the final, eighth tank 28 into the seventh tank 28 over the minor divider wall 34. The countercurrent flow carries on over the top of the final, major dividing wall 25 into the sixth tank 28 in the third section 23, through its air bubble 36, and so on until the increased level in the first wash tank 28 of the first section 23 is removed through a drain outlet 52. As an alternative to countercurrent flow over the top from one container 20 to a previous one, the wash solution 24 may be transferred by pumping. Recirculation pumps (not shown) may also fitted to each wash tank 28 to effect agitation of the solution at the bottom thereof. It will be appreciated that as processing of the film 12 takes place, and in particular as it proceeds through the eight wash tanks 28, the concentration of the wash solution 24 will vary from one tank to another as the active chemicals are transferred from the film 12 to the solution 24.

As exemplified, the flow of wash solution 24 is in counter-current mode, and to facilitate this, the heights of the major and minor dividing walls 25 and 34 respectively are reduced progressively in the direction of flow of the solution 24. The roller/guide assemblies 38 and 30 may also be located progressively lower in the container 20 so as to minimize the volumes of their associated air bubbles 48 and 36.

It is to be understood, however, that each tank 28 may be isolated from adjacent tanks insofar as flow of solution is concerned. In this latter case, each tank may be replenished individually, with the air bubbles 36 and 48, and associated dividing walls 34 and 25 respectively, serving to ensure that there is no flow of solution between the tanks.

In a further embodiment, the solution in the container may be arranged to flow therethrough in a co-current mode, that is to say, in the same direction as travel of the film. In this case, the heights of the dividing walls may be increased progressively in the same direction.

It is also to be understood that at least one of the tanks 28 may contain a processing solution that is different from that contained in at least one other of the tanks.

The container may contain more, or fewer, than the eight tanks exemplified in the drawing, and/or more than one container may be provided, so as to produce apparatus for carrying out complete processing, that is to say the developing and bleach/fixing, of photographic material using the principles of the present invention.

The invention has been described in detail with particular reference to preferred embodiments thereof, but it will be understood that variations and modifications can be effected within the scope of the invention.

PARTS LIST

12 film
18 wash stage
20 container
22 arrangements
23 sections
24 solution
25 wall
26 wall
28 tank
30 roller/guide assemblies
32 roller/guide assemblies
34 wall
36 bubble of air
38 roller/guide assembly
39 assemblies
40 ribs
42 cover
44 inlet
46 outlet
48 bubble of air
50 inlet pipe

52 drain outlet

222 arrangements

What is claimed is:

1. Apparatus for processing photographic material, comprising a container that has at least four successive regions for containing processing solution, wherein the regions are separated by walls each of which has guide means and a chamber associated therewith, whereby the photographic material is arranged to be guided from one processing region to the next through gas that is trapped by the solution in the intervening chamber.

2. Apparatus according to claim 1, wherein the processing solution in each region is effective to carry out the same processing, preferably washing, of the material.

3. Apparatus according to claim 2, wherein the processing solution in at least one region is arranged to carry out processing of the material that is different from that carried out in at least one other region.

4. Apparatus according to claim 1, wherein the processing solution in at least one region is arranged to carry out processing of the material that is different from that carried out in at least one other region.

5. Apparatus according to claim 1, wherein alternate chambers are located at the top and at the bottom of the container.

6. Apparatus according to claim 1, comprising means arranged to cause the processing solution to flow therethrough in a direction counter to the direction of movement of the material.

7. Apparatus for processing photographic material comprising a container for receiving processing solution through which the material is arranged to pass, wherein the container comprises means for guiding the material in a sinuous path such that the material reverses its vertical direction of movement (3+4n) times, where n is a positive integer, with the reversals taking place alternately in the solution and in gas that is trapped in chambers of the container by the solution.

8. A method of processing photographic material wherein the material is guided through at least four successive regions defining separate processing steps and containing processing solution, and wherein the material passes from each region to the next through a trapped gas bubble.

9. A method according to claim 8, wherein the material moves in a sinuous path alternately through processing solution and through gas.

10. A method according to claim 9, wherein the material moves in a generally downwards direction before passing through one bubble and generally upwards before passing through the next bubble.

11. A method according to claim 9, wherein the vertical component of the direction of travel of the material reverses as it passes through each bubble.

12. A method according to claim 8, wherein the material moves in a generally downwards direction before passing through one bubble and generally upwards before passing through the next bubble.

13. A method according to claim 12, wherein the vertical component of the direction of travel of the material reverses as it passes through each bubble.

14. A method according to claim 8, wherein the vertical component of the direction of travel of the material reverses as it passes through each bubble.

* * * * *